United States Patent [19]

Knieper et al.

[11] 4,424,903

[45] Jan. 10, 1984

[54] APPARATUS FOR STORING TRITIUM, ESPECIALLY TRITIUM WASTES FROM NUCLEAR POWER PLANTS

[75] Inventors: Josef Knieper, Baesweiler; Heinz Printz, Titz-Rodingen; Robert Wolfle, Julich, all of Fed. Rep. of Germany

[73] Assignee: Kernforschungsanlage Julich GmbH, Julich, Fed. Rep. of Germany

[21] Appl. No.: 247,310

[22] Filed: Mar. 25, 1981

[30] Foreign Application Priority Data

Mar. 26, 1980 [DE] Fed. Rep. of Germany ..... 3011602

[51] Int. Cl.[3] ..... G21F 5/02

[52] U.S. Cl. ..... 206/525; 206/591; 252/630; 252/633

[58] Field of Search ..... 252/630, 633; 250/506; 423/648 A; 206/525, 591

[56] References Cited

U.S. PATENT DOCUMENTS

| | | | |
|---|---|---|---|
| 3,432,666 | 3/1969 | Nash et al. | 250/506 |
| 3,754,141 | 8/1973 | Leebl et al. | 250/506 |
| 3,935,467 | 1/1976 | Gablin | 250/506 |
| 4,158,639 | 6/1979 | Berty | 252/630 |
| 4,315,831 | 2/1982 | Morin et al. | 252/628 |

FOREIGN PATENT DOCUMENTS

| | | | |
|---|---|---|---|
| 50-73098 | 6/1975 | Japan | 252/630 |
| 54-102400 | 9/1979 | Japan | 252/630 |

*Primary Examiner*—Deborah L. Kyle

*Attorney, Agent, or Firm*—Shlesinger, Arkwright, Garvey & Fado

[57] ABSTRACT

A process and apparatus for storing tritium, particularly tritium waste from nuclear power plants, wherein the tritium is first oxidized to HTO or $T_2O$ and is then bound to an adsorbent having molecular sieve properties, and the tritium-containing adsorbent being enclosed by a corrosion-resistant metal container hermetic with respect to hydrogen diffusion.

12 Claims, 2 Drawing Figures

Figure 1:
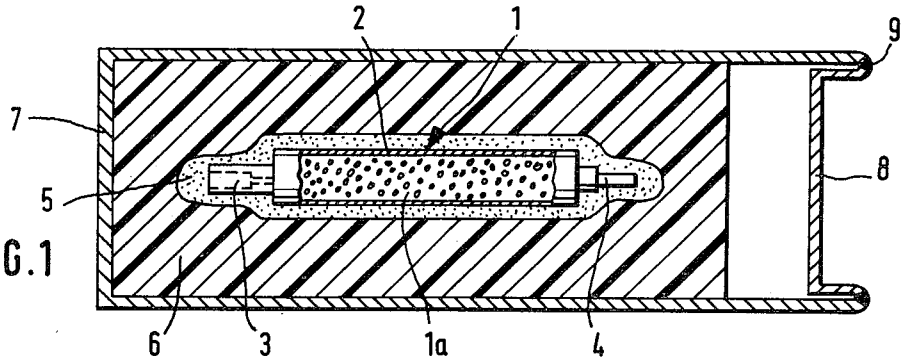

APPARATUS FOR STORING TRITIUM, ESPECIALLY TRITIUM WASTES FROM NUCLEAR POWER PLANTS

This invention concerns a process for storing tritium, especially tritium wastes from nuclear power plants, and equipment for the implementation of this method.

The long-term storage of radioactive materials, in particular wastes from nuclear power plants, requires compliance with strict safety demands. It is necessary for instance to enclose the materials in containers of the lowest possible permeation rates and with the highest possible tightness at the closure sites. The container material furthermore must evince high mechanical strength, high reliability to pressure and incombustibility or fire-retardant properties. If the containers are for the purpose of final storage, they must be optimally protected against the effects of corrosion as well. This corrosion protection must be comprehensive as the possible final deposition sites are not yet known individually today.

Heretofore tritium has been cast in concrete for the purpose of final storage. This is permissible, however, only up to amounts of 10 millicuries due to the properties of concrete. Therefore the elimination of substantial amounts of tritium is very costly. This condition may assume significance when the technology of fusion shall have progressed, as it requires tritium.

The object of the invention is therefore to provide a process by means of which tritium and substances containing tritium can be reliably stored in problem-free manner and be recovered at any arbitrary time.

This problem is solved by the invention in that the tritium is oxidized to HTO or $T_2O$ bound to an adsorbing agent having molecular sieve properties, and then enclosing this adsorbent in a corrosion-proof metal container impervious to hydrogen diffusion. Using this process, even substantial amounts of tritium can be relatively safely stored. An especial advantage is that tritium can be recovered in a simple manner. The tritium oxidation can be carried out for instance by oxidzing HT or of tritiated organic compounds on heated cupric oxide.

The oxidized tritium can be easily bound to the adsorbent in a dry inert gas atmosphere. Appropriate inert gases include dry air, nitrogen or argon. The inert gas can be used in the same manner also in the recovery of the tritium.

The equipment of the invention to store the tritium is characterized by a metal container hermetic to hydrogen diffusion, wherein a molecular sieve, loaded with tritium in the form of HTO or $T_2O$ and surrounded by a filler is enclosed. Zeolites are contained in an envelope in the molecular sieve and for the purpose of the present application evince the highest possible selectivity for water vapor and a high thermal stability in the loaded state to above 300° C. Other natural or synthetic molecular sieves may also be used.

The container may consist for instance of pure aluminum, titanium or high-grade steel, as these metals are especially hermetic with respect to hydrogen diffusion and furthermore are corrosion-proof. Pure aluminum in particular is well suited, as it evinces a very low permeation rate for HT, a high flexibility and hence low risk of rupture, an insensitivity to radiolysis, incombustibility, and insensitivity to water on account of the formation of a cohesive aluminum oxide layer which should be 50 to 60 Å. This layer can be made thicker by anodic oxdiation to 5 to 6 microns, thereby achieving additional inhibition of permeation.

To achieve reliable and completely tight sealing, the container should be provided with a blind flange or be welded. Welding preferably is carried out by electron beams in a vacuum. The cavity so created offers high reliability with respect to pressure increase inside due to radiolysis or dissociation of gases at high temperatures.

A possible additional safety measure may consist in jacketing the container with glass-fiber reinforced plastics, for instance resins of polyester, phenol or epoxy, or with material of the kind utilized in making heat-shields for space capsules (ablative compounds). Thereby the mechanical strength is increased further and the resistance to corrosive liquids or gases is still further improved.

A cartridge of pure aluminum should enclose the molecular sieve. The cartridge also may be provided with an aluminum oxide layer 50 to 60 Å thick, and where appropriate with an anodic oxidation coating.

Quick-connect seals of a known type are used to fill the cartridge. These seals are so designed that they will automatically open only when connecting means adapted thereto are mounted on them. Otherwise they will be sealed in vacuum-tight manner, so that there is no danger of contamination. Moreover they can be opened anytime without risk of contamination, for instance to dilute the tritium to a lesser specific final storage activity or to withdraw it in controlled manner by passing through it a flow of an inert gas. When passing a flow of inert gas through it, the amount and the concentration of the tritium can be controlled by setting a selected temperature in the range from −190° to +300° C. The amount withdrawn can be precisely metered as desired.

It is possible also to enclose more than one molecular sieve in one container. In such a case it will be appropriate to provide references sites of rupture in the region between the seives so these can be removed individually. The remaining molecular sieves then remain encased and can be stored again.

Another feature of the invention provides that the filler consist of a plastic, for instance a resin of polyester, epoxy or phenol, and/or of plaster and/or cement. These materials, especially the last three cited, do not promote or sustain combustion.

In addition, a wax partition should be provided between the molecular sieve and the filler. Due to the softer consistency of the wax, the molecular sieve, especially when provided with quick-connect seals will be protected against damage if there is subsequent opening, since the partition wax prevents a direct combining with the filler. Both the filler and the wax may absorb slight amounts of tritium that remained adhering at the closure means of the cartridge during the process. Due to the varied chemical corrosion possible, the multilayer design provides optimal protection against external corrosion.

A plurality of the containers according to the invention may also be housed within 200-liter waste containers, which then are filled with concrete and moved to the final storage site, for instance a salt mine.

The invention is shown in greater detail by means of embodiments indicated in the drawings.

Figure 2:
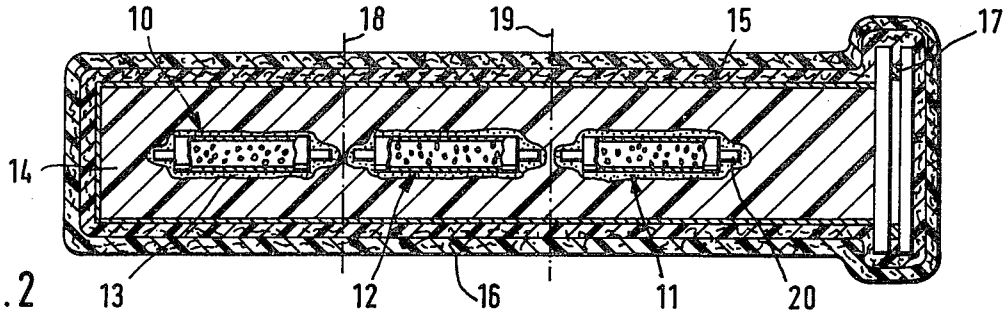

FIG. 1 is a longitudinal cross-sectional view of the container for storing tritium, with a molecular sieve therein; and FIG. 2 is a longitudinal cross-section of a container with three molecular sieves therein.

FIG. 1 shows a molecular sieve 1 consisting of a molecular sieve filling 1*a* surrounded by a cartridge 2 made of pure aluminum and provided with quick-connect seals 3, 4. The cartridge 2 is enclosed in a wax partition layer 5 so as to be isolated from the filler 6 into which the molecular sieve 1 is embedded. The outer jacket is formed by a container 7, for instance also made of pure aluminum, which is closed by a lid 8. The seal is made hermetic by a welding seam 9.

FIG. 2 shows another container for storing tritium, and includes three molecular sieves 10, 11, 12 in cartridge form embedded therein. These molecular sieves 10, 11, 12 each are enclosed by a wax partition layer 13 and by a filler means 14, for instance plastic or plaster, and by a container 15 made of pure aluminum. The container 15 additionally is encased by a multi-ply glass-fiber reinforced plastic layer 16 and is sealed by means of a blind flange with a metal seal 17. The plastic layer 16 seals the container 15 hermetically against gases and liquids and provides good protection against corrosive liquids.

If subsequently the container must be separated or reopened, this may be done by sawing, the molecular sieves 10, 11, 12 being then exposed. To facilitate this separation, reference rupture sites 18, 19 may be provided on the container 15.

The moment the molecular sieves 10, 11, 12 are exposed, the quick-connect seals 10 may be hooked up to a gas or rinsing line. By passing an inert gas through the tritium, it can be dissolved out of the molecular sieves 10, 11, 12. These seals are designed as the so-called quick-connect seals which open automatically when the mating connectors are set on them, while otherwise they seal in absolutely vacuum-tight manner.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

We claim:

1. An apparatus for storing tritium for a desired period of time in an accessible cartridge which is adapted for passage of gases therethrough which can both supply and remove tritium therefrom at a desired rate, comprising:

(a) a closed and sealed outer waste container, (b) the waste container being filled with a filler material, (c) an elongated storage cartridge disposed centrally within the waste container and surrounded by the filler material, (d) the said elongated storage cartridge having a quick-connect seal member at each end for facilitating the passage of gases therethrough and operable only when connecting means are mounted on them, (e) the storage cartridge being filled with molecular sieve material having a high selectivity for water vapor and high temperature resistance in the loaded state, (f) the said storage cartridge having a relatively thin wall and being formed of a corrosion-resistant material which is hermetic to hydrogen diffusion, (g) the molecular sieve material containing oxidized tritium in the form of HTO or $T_2O$, and (h) a relatively thick readily frangible shell partition disposed between the filler material and the said cartridge which it encases, whereby the cartridge can be freed from the filler material without damage and its quick-connect seals readily connected it to an inert gaseous supply for removal of the tritium from the molecular sieve.

2. Apparatus as in claim 1, characterized in that said container (7, 15) is made of a metal selected from the group consisting of pure aluminum, titanium or high-grade steel.

3. Apparatus as in claim 2, characterized in that said metal is aluminum and said container (7, 15) is provided with an oxide layer of 50 to 60 Å possibly reinforced by an anodic coating layer.

4. Apparatus as in claim 1, characterized in that the container (7, 15) is welded shut or provided with a blind flange.

5. Apparatus as in claim 1, characterized in that the container (15) is encased with glass-fiber reinforced plastic, for instance polyester-, phenolic- or epoxy-resins, or with an ablative material.

6. Apparatus as in claim 1, 4 or 5, characterized in that the molecular sieve (1, 10, 11, 12) is encased by a cartridge (2) made of pure aluminum.

7. Apparatus as in claim 6, characterized in that said cartridge (2) is provided with an oxide layer of 50 to 60 Å possibly reinforced by an anodic coating layer.

8. Apparatus as in claim 6, characterized in that the cartridge (2) is provided with rapid sealing means of the type of the quick-connect seals.

9. Apparatus as in claim 1, characterized in that a plurality of said molecular sieve cartridges (10, 11, 12) are enclosed in said container (15).

10. Apparatus as in claim 9, characterized in that said container (15) comprises reference rupture sites (18, 19) in the regions between the molecular sieves (10, 11, 12).

11. Apparatus as in claim 1, characterized in that said filler (6, 14) comprises a material selected from the group consisting of polyester-, phenolic- or epoxy-resins, plaster, and cement.

12. Apparatus as in claim 1, characterized including a wax partition layer (5, 13) between the molecular sieve (1, 10, 11, 12) and the filler (6, 14).

* * * * *